United States Patent [19]

Bogdanov et al.

[11] Patent Number: 4,917,312

[45] Date of Patent: Apr. 17, 1990

[54] BALL TUBE MILL

[76] Inventors: Vasily S. Bogdanov, ulitsa Kostjukova, 36, kv. I03; Ivan I. Miroshnichenko, ulitsa Kostjukova, 36, kv. 63; Nikolai S. Bogdanov, bulvar Pervogo Saljuta, 4, kv. 84; Nikolai D. Vorobiev, ulitsa Kostjukova, 36, kv. 3, all of Belgorod; Vladimir Z. Pirotsky, ulitsa Staroslobodskava, I4, kv. 7I, Moscow; Ivan N. Shevchenko, ulitsa Dovatora, 62, kv. 68, Cherkessk, all of U.S.S.R.

[21] Appl. No.: 220,554

[22] Filed: Jul. 18, 1988

[51] Int. Cl.[4] ..... B02C 17/06

[52] U.S. Cl. ..... 241/72; 241/179

[58] Field of Search ..... 241/179, 181, 182, 153, 241/71, 72

[56] References Cited

U.S. PATENT DOCUMENTS

| | | | |
|---|---|---|---|
| 1,683,627 | 9/1928 | Read | 241/72 |

FOREIGN PATENT DOCUMENTS

| | | | |
|---|---|---|---|
| WO88/03055 | 5/1988 | PCT Int'l Appl. | 241/72 |
| WO88/03056 | 5/1988 | PCT Int'l Appl. | 241/72 |
| WO88/03438 | 5/1988 | PCT Int'l Appl. | 241/72 |
| 1024101 | 6/1983 | U.S.S.R. . | |

*Primary Examiner*—Mark Rosenbaum

*Attorney, Agent, or Firm*—Lilling & Greenspan

[57] ABSTRACT

A ball tube mill has a housing with an inlet and an outlet for material to be comminuted accommodates annular wall plates spaced at a predetermined distance from each other, arranged at an angle to the longitudinal axis of the housing, and having the form of an ellipse. The space between the adjacent annular wall plates is somewhat greater than D/tan $\alpha$, where D is the inside diameter of the housing, and $\alpha$ is the inclination angle of the annular wall plate to the longitudinal axis of the housing.

4 Claims, 2 Drawing Sheets

BALL TUBE MILL

BACKGROUND OF THE INVENTION

This invention relates generally to the art of comminuting hard materials, and more particularly to ball tube mills.

The invention can find application in the cement industry, in mining, and for other industrial uses, where fine grinding of materials is essential.

DESCRIPTION OF THE PRIOR ART

There is known a ball tube mill comprising a housing having an inlet for admitting a material to be comminuted and an outlet for discharging the material, and accommodating a perforated wall member separating the interior of the housing into coarse and fine grinding chambers. Arranged inside the fine grinding chamber at a predetermined space from each other are annular wall plates secured perpendicularly to the longitudinal axis of the housing. Some of these wall plates are of a smaller inside diameter and have perforations. Other wall plates have a larger inside diameter and have no perforations. The perforated and non-perforated annular wall plates alternate. The housing has a perforated grid element before the outlet hose (cf., e.g., USSR Inventor's Certificate No. 1,024,101 published in the Bulletin "Discoveries, Inventions, Industrial Designs, Treademarks" No. 23, published June 23, 1983).

In the heretofore describe ball tube mill the annular wall plates improve the quality of the end product, although fail to influence the pattern of movement (work) of the grinding bodies. The grinding bodies present in the housing of the mill between the annular wall plates move exclusively transversely of the housing, and are elevated to an angle of 35°, whereby the material is ground mostly by impact. The grinding bodies present in the central part of the charge tend to form stagnation zones, and fail to take part in the comminution process, which results in a low efficiency of the grinding process.

In addition, the annular wall plates form baffles and produce bridging, which reduces the longitudinal velocity of the particles of the material being comminuted from the inlet to the outlet of the housing. As a result, the dwell time of the particles in the housing of the mill increases to cause excessive comminution of the material, reduced throughput capacity of the mill, and adhesion of the material to the grinding bodies and lining of the housing.

SUMMARY OF THE INVENTION

It is an object of the present invention to ensure a higher efficiency in comminuting hard materials through a more rational distribution of the energy of the grinding bodies.

The objects of the invention are attained by a ball tube mill a housing of which has an inlet and an outlet for a material to be comminuted and accommodates annular wall plates arranged in succession with a predetermined space therebetween. According to the invention, the wall plates are disposed at an angle to the longitudinal axis of the housing and have the form of an ellipse, the space between the adjacent annular wall plates being somewhat greater than D/tan, where D is the inside diameter of the housing, and $\alpha$ is the inclination angle of the annular wall plate to the longitudinal axis of the housing.

Preferably, the annular wall plates are arranged at an angle of 45°–65° to the longitudinal axis of the housing. This range of inclination angles ensures the highest efficiency of the comminution process.

Advisably, the inside diameter of the annular wall plates grows exponentially downstream of the flow of the material being ground from the inlet to the outlet of the housing.

Such an arrangement of the annular wall plates ensures the most rational distribution of the energy of the grinding bodies lengthwise of the housing of the mill.

Favourably, each annular wall plate has a shortened length along the major axis of the ellipse equal to 0.3–0.5 the diameter of the housing, and further has a flat end parallel with the minor axis of the ellipse, the adjacent annular wall plates being offset relative to each other to an angle of 180°.

This arrangement of the annular wall plates intensifies the transverse and longitudinal movement of the grinding bodies for them to acquire the greatest amount of energy, which again increases the efficiency of grinding of comminutable materials difficult to grind.

Preferably, the annular wall plates are offset one relative to another about like axes to angle of 90°.

Such an arrangement of the annular wall plates ensures uniform intensification of the movement of the grinding bodies with each revolution of the housing of the mill.

In view of the foregoing, the ball tube mill embodying the present invention substantially envigorates the work of the grinding bodies due to the longitudinal movement thereof. Other advantages provide that stagnation zones in the central part of the charge are obviated, the velocity of particles travelling through the mill is increased, and a more rational distribution of the energy of the grinding bodies lengthwise of the housing of the mill is ensured. These advantages result in improved efficiency of the comminution process.

BRIEF DESCRIPTION OF THE DRAWINGS

The invention will now be described in greater detail with reference to specific embodiments thereof taken in conjunction with the accompanying drawings, in which.

DESCRIPTION OF THE PREFERRED EMBODIMENTS

Figures 1, 2:
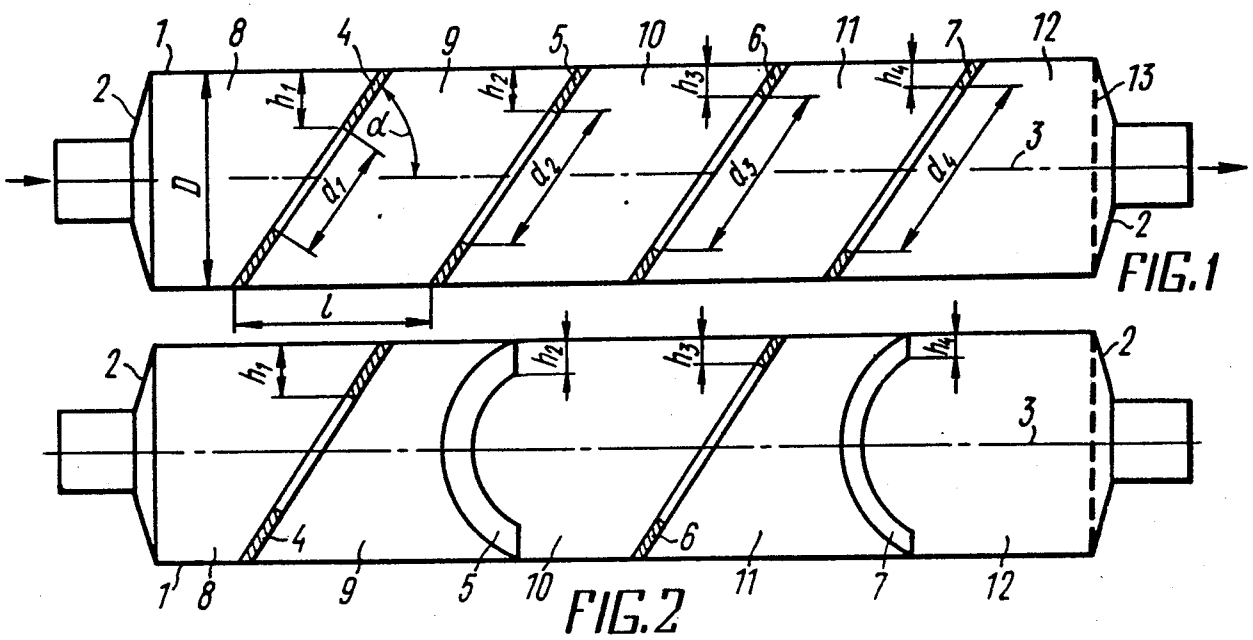
FIG. 1 is a longitudinal sectional view of a ball tube mill according to the invention with parallel annular wall plates.
FIG. 2 shows the ball tube mill with wall plates alternately offset relative to each other to an angle of 90°.

A ball tube mill comprises a housing 1 (FIG. 1) closed at the ends by cover caps 2. The cover caps 2 have through inlet and outlet holes (not shown) for feeding a material to be comminuted to and discharging it from the mill. Arranged successively inside the housing 1 at an angle $\alpha$ to its longitudinal axis 3 are annular wall plates 4, 5, 6 and 7 which can be either continuous or perforated. These wall plates are spaced from each other at a distance l. The distance l between the adjacent wall plates 4, 5; 5, 6; and 6, 7 is preferably somewhat greater than D/tan where D is the inside diameter of the housing 1, and $\alpha$ is the angle of inclination of the annular wall plates 4, 5, 6 and 7 to the axis 3 of the housing 1.

The angle $\alpha$ of inclination of the annular wall plates 4, 5, 6 and 7 to the longitudinal axis 3 of the housing 1 ranges from 45° to 65°. The value of the angle $\alpha$ is selected depending on the physical and mechanical properties of the particles of the material being comminuted. A smaller angle is preferable difficulty comminutable materials, whereas for easily comminutable materials this angle is preferably greater.

Such preference of angle selection can be accounted for by the folowing. During comminution the size of the particles of the material diminishes as they move from the inlet to the outlet from the housing 1 according to the Rozin-Rammler exponential law $R_x = r_o e^{-bxn}$, where $R_o$, $R_x$ represent the total remainder of the material being comminuted on a test sieve taken at the inlet and outlet from the mill; b, n are the parameters depending on the susceptibility of the material to comminution; and x is the size of the particles of the material being comminuted.

It is known that particles of over 1 mm across can be effectively ground by impact, whereas particles of less than 1 mm across can be ground by attrition. It has also been found that particles of over 1 mm in size virtually cannot be ground by attrition in a ball tube mill.

In consequence, the initial sections of the housing 1 in zones 8, 9, 10 should preferably provide for predominantly impact (cascade) operation of grinding bodies (not shown) to ensure impact grinding of the large-size grain fraction of the material. With this aim in view, the height $h_1$ and $h_2$ of the respective annular wall plates 4 and 5 should be such as to raise the maximum mass of the grinding bodies, i.e., the height $h_1$ of the annular wall plate 4 is to be greater than the height $h_2$ of the annular wall plate 5 ($h_1 > h_2$).

As the size of the particles of the material being ground diminishes in the course of their travel to the outlet of the mill, the impact energy of the grinding bodies has a tendency to become less pronounced. Material particles of less than 200 mkm across are preferably ground by attrition. For this purpose the inside diameter d of the annular wall plates 6 and 7 is increased so that $d_3 < d_4$, whereas the height $h_3$ and $h_4$ of the wall plates 6 and 7 are correspondingly reduced to $h_4 < h_3$.

The height h of the annular wall plates 4, 5, 6 and 7 also decreases exponentially lengthwise of the longitudinal axis 3 of the housing 1 in accordance with relationship $h_{i+1} = h_i l - bl^n$, where $h_i$, $h_{i+1}$ are the heights of the preceding and succeeding annular wall plates; l is the distance (space) between the adjacent annular wall plates; and b, n are parameters depending on the properties of the material being comminuted determined from the Rozin-Rammler equation.

The annular wall plates 4, 5, 6 and 7 (FIG. 1) are arranged so that their major and minor ellipse axes are parallel.

With reference to FIG. 2, the annular wall plates 4, 5, 6 and 7 are successively offset about the like axes of the ellipse at an angle of 90°, which ensures that the movement of the grinding bodies is uniformly intensified during each revolution of the housing of the mill.

A perforated grid member 13 is provided at the outlet from the housing 1 to prevent the escape of large-size particles of the material and grinding bodies from the mill.

Figure 3:
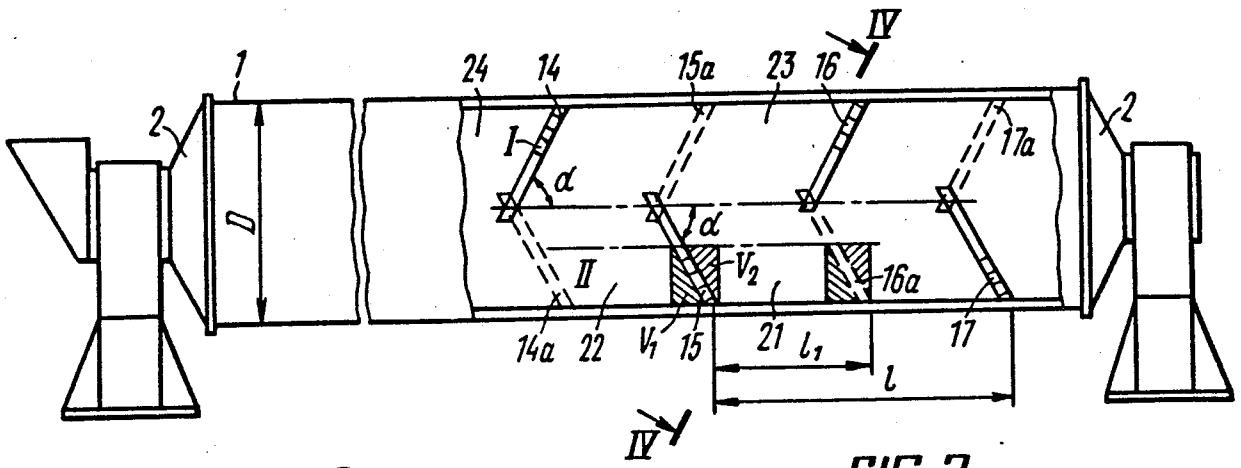
FIG. 3 is a view of the proposed ball tube mill with shortened wall plates.
Figure 4:
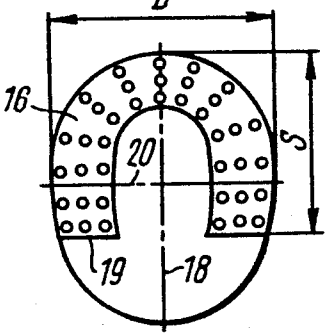
FIG. 4 is a section taken along the line IV–IV in FIG. 3.

Referring now to FIG. 3, for a more vigorous movement of the grinding bodies across and lengthwise of the housing ensuring communition of particles difficult to grind each annular wall plate 14, 15, 16 and 17 has a shorter length S along the major axis 18 (FIG. 4) of the ellipse equalling 0.3–0.6 D, where D is the inside diameter of the housing 1. An end 19 of the annular wall plates 14, 15, 16 and 17 is flat and runs parallel with the minor axis 20 of the ellipse. The adjacent annular wall plates 14, 15, 16 and 17 are offset relative to each other at an angle of 180°.

This arrangement of the annular wall plates ensures a cascade flow of the grinding bodies and provides conditions for impact and vibration grinding in the zone of falling of the grinding bodies. Selective comminution is therefore executed, whereby large-size particles break under the action of impact loads, whereas smaller particles are comminuted by vibration and attrition loads. This ensures a more efficient use of the energy of the grinding bodies for grinding particles of the material of various size.

The length S of each wall plate is determined in the following manner. For comminutable materials difficult to grind the length S of the annular wall plates 14, 15, 16 and 17 is preferably greater, viz., up to S=0.6 D. For easily comminutable materials this length S of the annular wall plates 14, 15, 16 and 17 is smaller, viz., S=0.3 D.

The ball tube mill according to the invention operates as follows.

The operation of the ball tube mill will be discussed with respect to one of the annular wall plates, such as wall plate 4. Other annular wall plates 5, 6 and 7 function in a similar manner.

In the course of rotation of the housing 1 the annular wall plate 4 acts to scoop the grinding bodies present in the zones 8 and 9, raise them to an angle 80° . . . 90° and dump them in a cascade fashion in the zone 8 toward the cover cap, and in the zone 9 toward the base of the annular wall member 5 thus comminuting the material.

The annular wall plates 5, 6 and 7 cooperate in a likewise manner scoopng the grinding bodies, respectively, in the zones 9, 10; 10, 11; and 11, 12.

With the arrangement of the annular wall plates 4, 5, 6 and 7 at an angle to the longitudinal axis of the housing the angle to which the grinding bodies are raised increases from 35° to 90°, which in turn results in a growth in the overall energy (potential and kinetic) of the grinding bodies. Consequently, for ensuring an equal amount of work for comminution, i.e., work equalling the production capacity of the mill in the case of employing inclined annular wall plates, a smaller quantity of grinding bodies is required; and since the power consumed by the mill is directly proportional to the mass of the rotatable parts thereof (drum, lining, annular wall plates, grinding bodies, and material being comminuted), the reduction in the mass causes less power to be consumed.

In addition, the annular wall plates 4, 5, 6 and 7 agitate the movement of the grinding bodies relative to the transverse and longitudinal axes of the housing 1 to obviate stagnation zones in the central part across the charge and increase the efficiency of the comminution process.

With the annular wall plates 4,5, 6 and 7 arranged at an angle of 45° . . . 65° to the longitudinal axis 3 of the housing 1 at maximum comminution efficiency is attained. For example, at an angle $\alpha$ of inclination of the annular wall plates of 45° and the mass of the charge of grinding bodies inside the housing 1 of the mill of 166 kg the capacity of a pilot model of the mill amounted to 23.0 kg/h, grinding fineness 310 $m^2$/kg, and power consumption 1.98 kW. At $\alpha=65°$ the mill capacity was 23.2 kg/h, power consumption 1.92 kW, and grinding fineness 325 $m^2$/kg.

A reduction in the angle $\alpha$ of inclination of the annular wall plate to 40° brought the output capacity of the mill down to 17.3 kg/h, accompanied by an increase in power consumption to 2.15 kW, whereas the grinding fineness reduced to 290 $m^2$/kg. Increasing the angle of inclination of the annular wall plates to 70° or more affects the efficiency of the comminution process resulting in an output capacity of a pilot model mill 20,0 kg/h, power consumption 1.9 kW and grinding fineness 315 $m^2$/kg.

The reduction in the efficiency of the comminution process as the angle $\alpha$ of inclination of the annular wall plates 4, 5, 6 and 7 is reduced to below 40° is because the angle to which the grinding bodies present in the zones 8, 9, 10, 11 and 12 are raised is such that these bodies tend to flow over onto the inner suface of the housing failing to perform comminution work. As the angle to which the grnding bodies are raised grows, the amount of power consumed increases, whereas since the grinding bodies fall onto the inner surface of the housing, the result will be a coarser grinding and lower capacity of the mill terms of the required in grain size and higher specific consumption of power.

Conversely, increasing the angle of inclination of the annular wall plates 4,5, 6 and 7 to over 70° affects the efficiency of the comminution process due to a more vigorous longitudinal movement of the grinding bodies and a reduction in the angle to which these bodies are raised.

In view of the aforedescribed, the comminution process is most efficient at the angle $\alpha$ of inclination of the annular wall plates 4, 5, 6 and 7 to the longitudinal axis of the housing 1 selected within the range of 45° . . . 65°.

The height h of the annular wall plates 4, 5, 6 and 7 diminishes exponentially lengthwise of the axis 3 of the housing 1.

When comminuting easily grindable materials with no requirements as to the percentage of particles of the material of particular grain size in the end product, the annular wall plates 4, 5, 6 and 7 are preferably arranged as illustrated in FIG. 1. In this case these annular wall plates are parallel with their like ellipse axes also running in parallel.

Offsetting the annular wall plates 4, 5, 6 and 7 about the like minor ellipse axes successively relative to each other at 90° (FIG. 2) provides favourable conditions for a more vigorous grinding of the material by attrition, which facilitates comminution of particles of the material to a more narrow class. This arrangement of the annular wall plates is preferable for grinding a strong material.

At the first portions of the housing 1 of the mill in the zones 8, 9 and 10 containing larger size particles of the material it is necessary to ensure a cascade flow of the grinding bodies, i.e., grinding of the particles of the material by impact. For this purpose the height of the annular wall plates 4 and 5 should be such that they raise a greater mass of the grinding bodies, i.e., the height $h_1$ of the annular wall plate 4 should be greater than the height $h_2$ of the annular wall plate 5.

As the particles of the material move along the longitudinal axis 3 of the housing 1, their size is reduced under the action of the grinding bodies; the energy of the grinding bodies being likewise reduced. It is not advisable, for example, that particles of less than 200 mkm across present in the zones 11 and 12 be subjected toimpact grinding, as they are in the zones 8 and 9. This results not only in excessive wear of the grinding bodies, lining and annular wall plates, but also causes the reverse process, viz., agglomeration of the material.

Therefore the height of the annular wall plates 4, 5, 6 and 7 should preferably diminish exponentially as the particles of the material are reduced in size.

During rotation of the housing 1 the annular wall plates 4, 5, 6 and 7 act to scoop in the respective zones 8, 9, 10, 11 and 12 a mass of the grinding bodies in proportion to the height h of each of the wall plates to raise these grinding bodies to a height corresponding to a dip angle of 85°–90° and dump them in a cascade. The mateerial is thus comminuted. The highest power of impact of the grinding bodies on the material is attained in the zones 8 and 9 where the annular wall plate 4 having the greatest height $h_1$ is accommodated. Thereafter, the power of the grinding bodies diminishes exponentially, viz., the impact power of the grinding bodies in the zone 12 is minimal, since the material is ground here predominantly by vigorous longitudinal and transverse attrition.

When the like ellipse axes of the annular wall plates 4, 5, 6 and 7 are arranged in parallel (FIG. 1), the grinding bodies in each of the zones 8, 9, 10, 11 and 12 move in a pulse-wise manner. The amount of work produced by the grinding bodies in each zone 8, 9, 10, 11 and 12 varies from the minimum to the maximum for one revolution of the housing 1. In this case it is advisable to comminute mixtures including materials of different suscptibility to grinding, such as both strong and sot materials.

Offsetting the annular wall plates 4, 5, 6 and 7 to an angle of 90° about their like ellipse axes relative to each other (FIG. 2) ensures stabilized energy conditions for the operation of the grinding bodies through the cycle (one revolution of the housing 1) in each working zone 8, 9, 10, 11 and 12, since the impact energy depends on the height h of the wall plate, that is the mass of the grinding bodies elevated by each annular wall plate 4, 5, 6 and 7.

In this case it is preferable to comminute a mixture in which all the ingredients have substantially similar characteristics, such as all easily grindable, or all difficult to grind.

Offsetting the annular wall plates 4, 5, 6 and 7 about the ellipse axes to an angle greater or smaller than 90°, for example, to an angle 103° or to an angle 82°, complicates mounting of the annular wall plates and adjacent lining (not shown).

The use in the proposed ball tube mill of annular wall plates 4, 5, 6 and 7 with exponentially diminishing height ensures more efficient distribution of the energy of the grinding bodies lengthwise of the longitudinal axis 3 of the housing 1, which provides for a greater selectivity of the grinding process, ensures reduced specific consumption of power, and stabilizes the grain composition of the end product.

In the case when the ball tube mill is equipped with annular wall plates having a shorter length S (FIGS. 3 and 4) along the major ellipse axis, it operates in the following manner.

As the housing 1 turns 180°, the short annular wall plates 14 and 16 are moved downwards to assume the position illustrated in FIG. 3 at 14*a* and 16*a*. At the same time, the annular wall plates 15 and 17 move upwards to assume positions indicated at 15*a* and 17*a*.

During a subsequent rotation of the housing 1 the cycles are repeated, and the short annular wall members 14, 15, 16 and 17 assume the characteristic positions indicated at 14*a*, 15*a*, 16*a* and 17*a*. For example, when passing from the top to the bottom position, the zone 21 defined between the short annular wall plates 15 and 17 moves toward the charging end to the cover cap 2 to a distance $l_1$ to occupy the volume confined by the annular wall plates 14 and 16, which assume positions indicated at 14*a* and 16*a*. The entire mass of the grinding bodies and material being comminuted moves lengthwise of the longitudinal axis 3 of the housing 1 toward the charging end to execute vigorous grinding by attrition.

This movement is executed simultaneously by all the grinding bodies present in the bottom part of the housing 1 of the mill. In addition, each shortened annular wall plate 14, 15, 16 and 17, when, for example, passing from the bottom position 15 to the top position 15*a*, scoops the mass of grinding bodies of a volume $V_1$ present in the zone 22 to dump them in a cascade toward the charging end (cover cap 2), whereas of a volume $V_2$ of the grinding bodies present in the zone 21 to the opposite (discharging) end thus comminuting the material by cascade impacts. During a further rotation of the housing 1 the annular wall plates 14 and 16 assume, respectively, the bottom positions 14*a* and 16*a*, whereas the annular wall plates 15 and 17 assume the top positions 15*a* and 17*a*, respectively. Therewith, the zones 21 and 22 move lengthwise of the longitudinal centerline 3 of the housing 1 to return to the initial position, while moving the entire mass of the grinding bodies along the axis 3 of the housing 1 toward the charging end. The material is therefore comminuted by the grinding bodies executing longitudinal and transverse movement. Stagnation zones in the central part across the charge are distributed to result in a more vigorous comminution.

Thereafter, the cycle is repeated.

The grinding bodies present in each of the zones in one row, particularly in the zones 21, 22 and 23, 24 operate in a similar manner.

Providing shorter wall members 14, 15, 16 and 17 makes it possible to accommodate inside the housing 1 a greater number thereof by reducing the length S of the wall plate to S=0.3 D. An increase in the length of the annular wall plates to S=0.6 D or in excess of this value results in a fewer number of such annular wall plates, since with the small distance l between the short annular wall plates 14, 15, 16 and 17 the grinding bodies elevated by one wall plate, such as wall plate 14, tend to strike the adjacent annular wall plate in the opposite row, such as wall plate 15, and cause damage to such wall plates.

A reduction in the length S of the shorter annular wall plate to S=0.3 D and increase in the number of annular wall plates secured inside the housing 1 causes a more vigorous longitudinal movement of the grinding bodies to result in a more efficient grinding of the material by attrition.

With the reduction in the length S of the annular wall plates 14, 15, 16 and 17 to less than S=0.3 D, such as S=0.25 D, the volumes $V_1$ and $V_2$ are also reduced, as is the mass of the grinding bodies elevated by the annular wall plate to result in less efficient comminution of large-size lumps of the material, and therefore less efficient operation of the apparatus.

The arrangement of the shorter annular wall members 14, 15, 16 and 17 alternately inclined to the opposite sides provides favourable conditions for vigorous and uniform transverse and longitudinal movement of the grinding bodies throughout the cycle.

If the space between the adjacent short annular wall plates 14, 15; 15, 16 and 16, 17 is different, then in the course of the passage of the grinding bodies from the top to bottom position they travel a greater distance than when passing from the bottom to the top position. This results in non-uniform axial loads exerted on the annular wall plates to cause premature damage thereof.

When all the shorter annular wall plates 14, 15, 16 and 17 are arranged at different angles $\alpha$ to the longitudinal axis 3 of the housing 1, the grinding bodies have a tendency to congest the zone of the interior of the housing 1 where the annular wall plates are arranged at a greater angle $\alpha$.

Invigorating the movement of the grinding bodies and rational distribution of their energy lengthwise of the housing of the mill makes it possible to reduce the mass of the grinding bodies, consume less power for, and increase the efficiency of the comminution process.

What is claimed is:

1. A ball tube mill comprising:

a cylindrical housing having a diameter (D) mounted for rotation about its longitudinal axis and having two ends, one of said ends being provided with inlet means for supplying a material to be comminuted and the other of said ends being provided with outlet means for discharging the comminuted material;

milling bodies arranged in said housing; and annular wall plates having the shape of an ellipse and arranged in succession in said housing at an angle ($\alpha$) to the longitudinal axis thereof at a spacing (l) which is greater than a projection D tan $\alpha$ of the major axis of the ellipse of each of the annular wall plates on the longitudial axis of the housing, the inside diameter of each of said annular wall plates increasing along the flow of the material being comminuted.

2. A ball tube mill according to claim 1, wherein each of said annular wall plates is arranged at an angle of 45 to 65 degrees to the longitudinal axis of said housing.

3. A ball tube mill according to claim 1, wherein each successive of said annular wall plates is turned relative to the preceding one of said annular wall plates so that the angle between the minor axis of the preceding wall plate and the minor axis of the succeeding of said annular wall plates is equal to 90 degrees.

4. A ball tube mill according to claim 1, wherein each of said annular wall plates has, along the major axis of the ellipse, a shorter length equal to between 0.3 and 0.6 the diameter of said housing, and has a flat end parallel to the minor axis of the ellipse of the annular wall plate, the adjacent ones of said annular wall plates being offset relative to one another at an angle of 180 degrees.

* * * * *